US007611345B2

(12) United States Patent
Huang et al.

(10) Patent No.: US 7,611,345 B2
(45) Date of Patent: Nov. 3, 2009

(54) STRUCTURE FOR PREVENTING AXIAL LEAKAGE IN SCROLL COMPRESSOR

(75) Inventors: Shu-Er Huang, Hsinchu (TW); Kun-Yi Liang, Hsinchu County (TW); Yu-Choung Chang, Hsinchu County (TW); Chih-Chung Lo, Taoyuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/965,540

(22) Filed: Dec. 27, 2007

(65) Prior Publication Data

US 2008/0159892 A1 Jul. 3, 2008

(30) Foreign Application Priority Data

Dec. 29, 2006 (TW) ..... 95149927 A

(51) Int. Cl.
*F03C 2/00* (2006.01)
*F03C 4/00* (2006.01)
*F04C 18/00* (2006.01)
*F04C 2/00* (2006.01)

(52) U.S. Cl. ..... 418/55.5; 418/55.1; 418/57; 418/107; 418/180; 418/270; 417/310; 417/410.5

(58) Field of Classification Search ..... 418/55.1–55.6, 418/57, 180, 104, 107, 270; 417/310, 410.5
See application file for complete search history.

(56) References Cited

U.S. PATENT DOCUMENTS 5,540,572 A * 7/1996 Park et al. ..... 418/55.5
5,613,841 A * 3/1997 Bass et al. ..... 418/55.5
6,059,549 A * 5/2000 Tarng et al. ..... 418/55.4
6,267,565 B1 * 7/2001 Seibel et al. ..... 417/292
6,913,448 B2 * 7/2005 Liang et al. ..... 418/55.5
6,913,488 B2 7/2005 Motojima et al.
7,207,787 B2 * 4/2007 Liang et al. ..... 418/55.1
7,364,416 B2 * 4/2008 Liang et al. ..... 418/55.5

FOREIGN PATENT DOCUMENTS

CN 2589697 Y 12/2003
JP 2003-028079 1/2003

* cited by examiner

*Primary Examiner*—Theresa Trieu
(74) *Attorney, Agent, or Firm*—Quintero Law Office

(57) ABSTRACT

A scroll type compressor is disclosed. The scroll type compressor includes a housing, a frame, a compartment, a separator, a scroll pairs, a slider, a plurality of compartments, at least a pressure-regulating mechanism, and a guiding element. The compartment in the housing is separated into a high-pressure compartment, a low-pressure compartment, and a middle-pressure compartment. The separator is disposed between the high-pressure compartment and the low-pressure compartment. The separator includes an outlet at the center thereof, and at least a passage through the separator. When the pressure in the high-pressure compartment is less than that in low-pressure compartment, the pressure-regulating mechanism is opened to exhaust pressure from the middle-pressure compartment to the high-pressure compartment.

13 Claims, 5 Drawing Sheets

STRUCTURE FOR PREVENTING AXIAL LEAKAGE IN SCROLL COMPRESSOR

BACKGROUND OF THE INVENTION

1. Field of the Invention

The invention relates to a scroll type compressor, and more particularly to a scroll type compressor having a pressure adjusting valve.

2. Description of the Related Art

A conventional scroll type compressor is a positive displacement and constant speed compressor. The volumetric ratio and the compression ratio are constant. When the variation of load causes the inlet and outlet pressure to change, the volumetric ratio and the compression ratio must also change. The conventional scroll type compressor, however, has a constant volumetric ratio and compression ratio, thus, over-compression or under compression results in degrading efficiency of the conventional scroll type compressor.

U.S. Pat. No. 6,913,488 discloses a compressor with a device load adjustor. The compressor includes a slider and a scroll for adjusting load variation to maintain a constant compression ratio. The inlet pressure is compressed and then discharged by the outlet. The variation of load does not affect the compression ratio, thus, the inlet and outlet pressure are not controlled.

BRIEF SUMMARY OF INVENTION

The invention provides a scroll type compressor. A pressure-regulating mechanism thereof adjusts the compression ratio improving efficiency.

The scroll type compressor comprises a housing, a frame, compartment, a separator, a scroll pair, a slider, a plurality of compartments, at least a pressure-regulating mechanism and a guiding element. The housing includes a flow inlet and a flow outlet. The frame is fixed in the housing. The compartment is disposed in the housing. The compartment is separated into a high-pressure compartment, a low-pressure compartment, and a middle-pressure compartment. The separator is disposed between the high-pressure compartment and the low-pressure compartment. The separator includes an outlet at the center thereof, and at least a passage through the separator. The scroll pair includes a fixed scroll and an orbiting scroll. The fixed scroll is engaged with the orbiting scroll, disposed between the separator and the frame. The slider is movably disposed at the center at the top of the fixed scroll. The pressure-regulating mechanism is disposed above the passage of the separator. The guiding element includes an air passage. The air passage is connected to the passage of the separator. When the pressure in the high-pressure compartment is less than that in middle-pressure compartment, the pressure-regulating mechanism is opened to exhaust pressure from the middle-pressure compartment to the high-pressure compartment.

Preferably, the pressure-regulating mechanism comprises a valve disposed above the passage. When the pressure in the high-pressure compartment is greater than that in the middle-pressure compartment, the valve seals the passage.

Preferably, the pressure-regulating mechanism further comprises a retaining element disposed above the valve.

Preferably, the guiding element further comprises a T-shaped element; the passage is installed on the T-shaped element.

Preferably, the guiding element further comprises a flexible element for maintaining the seal between the T-shaped element and the separator.

Preferably, the separator comprises a ring pin for preventing leakage of the pressurized airflow.

Preferably, the fixed scroll and the orbiting scroll further respectively comprise a sealing element.

Preferably, the fixed scroll at the top comprises a space at the top of the fixed scroll accommodating the slider.

Preferably, the space comprises a first chamber and a second chamber. The first chamber is disposed above the second chamber and the diameter of the first chamber is greater than the second chamber.

Preferably, the slider comprises a first portion and a second portion. The first portion is disposed above the second portion and the diameter of the first portion is greater than the second portion.

Preferably, the first portion and the second portion further respectively comprise an airtight element disposed on the outer edges of the first portion and the second portion.

Preferably, the airtight element comprises an O-ring.

Preferably, the slider further comprises a hole connected to the outlet.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
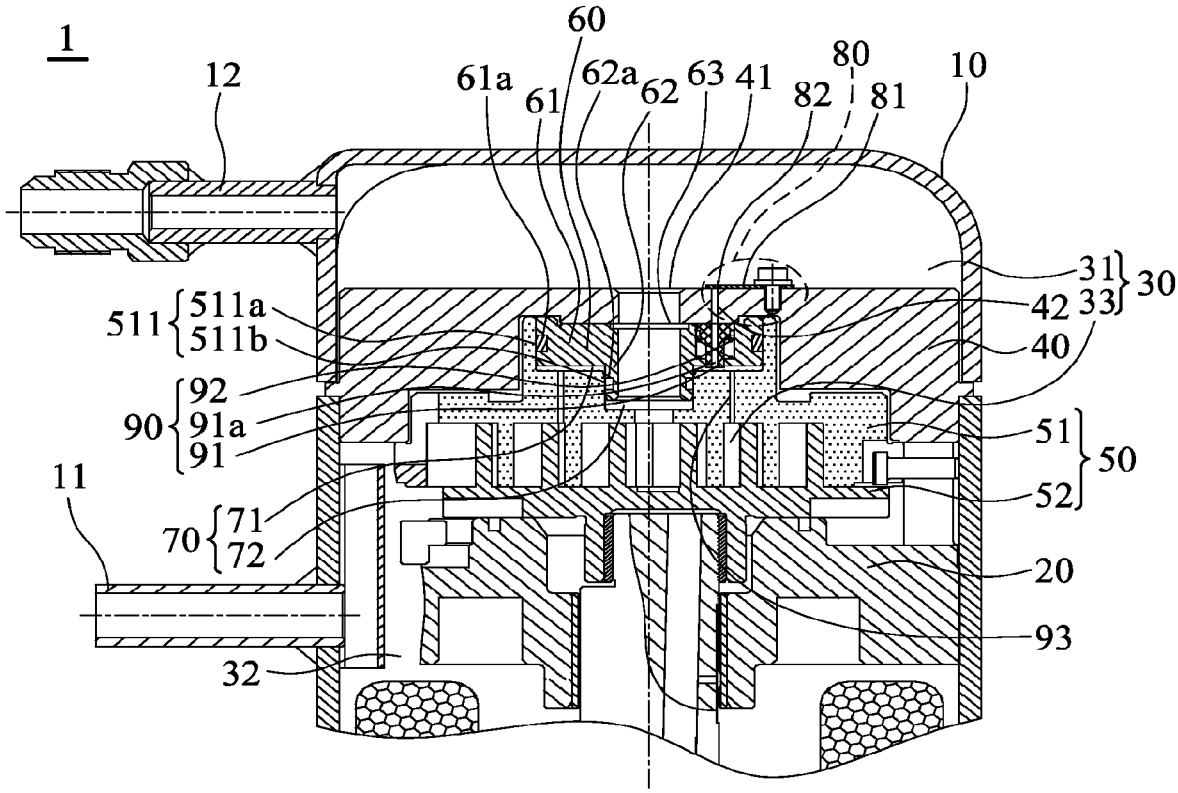
FIG. 1 shows a schematic view of a scroll type compressor of the invention.

Referring to FIG. 1, the scroll type compressor 1 comprises a housing 10, a frame 20, a compartment 30, a separator 40, a scroll pairs 50, a slider 60, two compartments 70, at least a pressure-regulating mechanism 80 and a guiding element 90. The housing 10 comprises a flow inlet 11 and a flow outlet 12. The frame 20 is fixed in the housing 10. The compartment 30 is disposed in the housing 10 and separated into a high-pressure compartment 31, a low-pressure compartment 32 and a middle-pressure compartment 33 disposed therebetween. The separator 40 is disposed between the high-pressure compartment 31 and the low-pressure compartment 32, and above the scroll pairs 50. The separator 40 comprises an outlet 41 at the center thereof, and at least a passage 42. The scroll pair 50 comprises a fixed scroll 51 and an orbiting scroll 52. The fixed scroll 51 is engaged with the orbiting scroll disposed between the separator 40 and frame 20. The fixed scroll 51 comprises a space 511 at the top thereof. The space 511 comprises a first chamber 511*a* and a second chamber 511*b*. The first chamber 511*a* is disposed above the second chamber 511*b* and the diameter of the first chamber 511*a* is greater than that of the second chamber 511*b*.

FIG. 1 shows the slider 60 movably disposed in the space 511 at the top of the fixed scroll 51. The slider 60 comprises a first portion 61 and a second portion 62. The first portion 61 is disposed above the second portion 62. The diameter of the first portion 61 is greater than the diameter of the second portion 62. The first portion 61 comprises an airtight element 61*a* and the second portion 62 comprises an airtight element 62*a*. The airtight elements 61*a* and 62*a* may be O-rings and are reflectively disposed on the outer edges of the first portion 61 and the second portion 62 preventing air leakage between the slider 60 and space 511. The slider 60 further comprises a hole 63 disposed at the center thereof and connected to the outlet 41. The compartments 70 comprise a first compartment 71 and a second compartment 72. The first compartment 71 is partitioned by the first portion 61 and the first chamber 511*a*. The second compartment 72 is partitioned by the second portion 62 and the second chamber 511*b*. The first compartment 71 communicates with the middle-pressure compartment 33. The pressure in first compartment 71 is thus equal to that in the middle-pressure compartment 33. Note that the scroll type compressor 1 further comprises a channel 93. The first compartment 71 and the second compartment 72 are disposed between the fixed scroll 51 and the slider 60. The first compartment 71 communicates with the middle-pressure compartment 33 through the channel 93 is formed in the fixed scroll 51.

Figure 2:
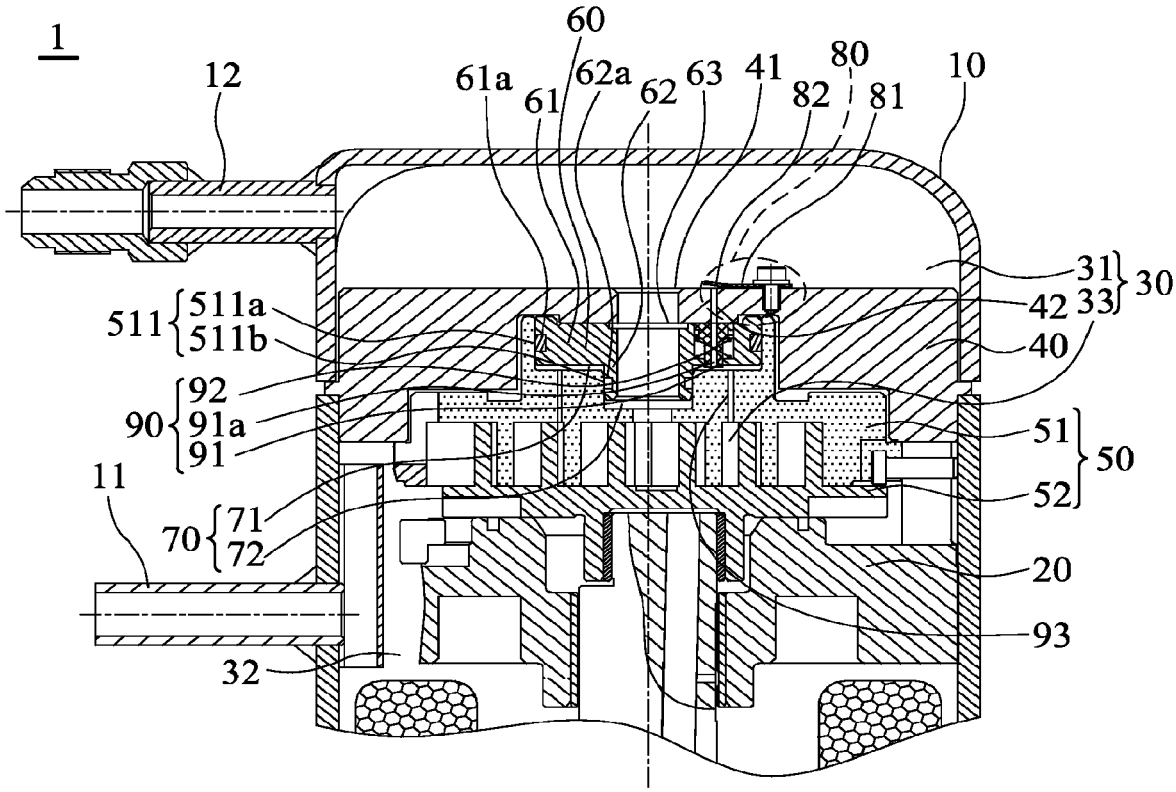
FIG. 2 shows a schematic view of a scroll type compressor of the invention when the pressure in the high-pressure compartment is lower than in the middle-pressure compartment.

The scroll type compressor 1 comprises at least a pressure-regulating mechanism 80 and a guiding element 90. The pressure-regulating mechanism 80 is disposed above the passage 42 and comprises a valve 81 and a retaining element 82 installed above the passage 42 in order. The valve 81 is flexible. The retaining element 82 prevents excessive deformation of the valve 81. The guiding element 90 is disposed in the back of the slider 60 and connected to the first compartment 71. The guiding element 90 comprises a T-shaped element 91 and a flexible element 92. The T-shaped element 91 comprises an air passage 91*a* connected to the passage 42. The flexible element 92 provides the T-shaped element 91 and the separator 40 seal. When the pressure in the high-pressure compartment 31 is higher than that in the middle-pressure compartment 33, the valve 81 is deformed to tightly seal the passage 42 shown in FIG. 1. Please refer to FIGS. 2 and 3, the pressure-regulating mechanism 80 opens to discharge the air from the middle-pressure compartment 33 to the high-pressure compartment 31 when the pressure in the high-pressure compartment 31 is lower than that in the middle-pressure compartment 33.

Figure 3:
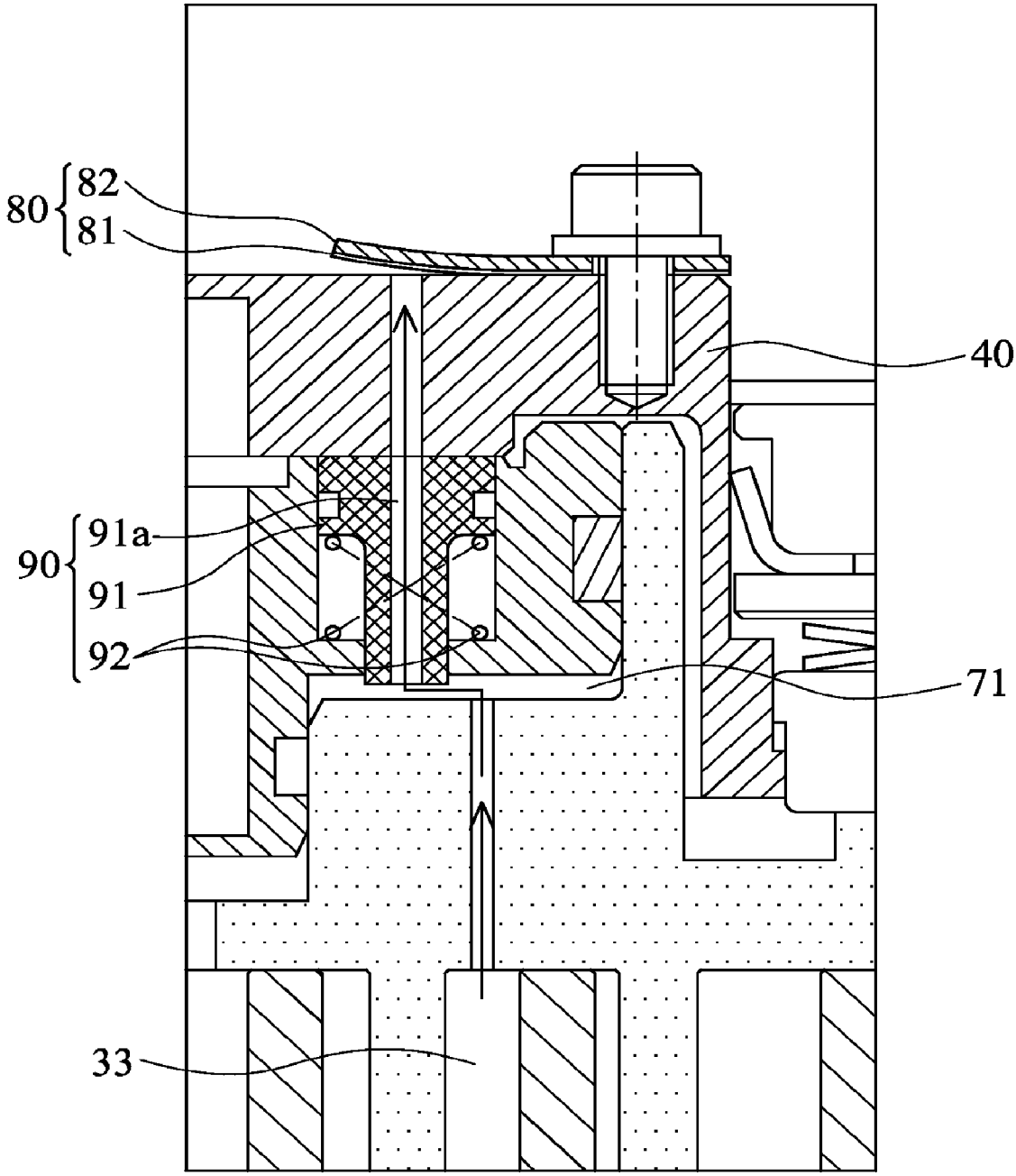
FIG. 3 is a schematic view of a pressure-regulating mechanism in FIGS. 1 and 2.

Referring to FIG. 3, when the pressure of air in the outlet 41 decreases, the pressure in the high-pressure compartment 31 is lower than that in the middle-pressure compartment 33. Thus, the compressed airflow discharged from the middle-pressure compartment 33 passes through the air passage 91*a* of the T-shaped element 91 and the passage 42 of the separator 40, and then enters the high-pressure compartment 31. Finally, the compressed airflow is discharged to outside by the flow outlet 12. Thus, heat loss of the airflow generated by over-compression is averted. Further, load of the scroll type compressor 1 is reduced, improving efficiency.

Figure 4:
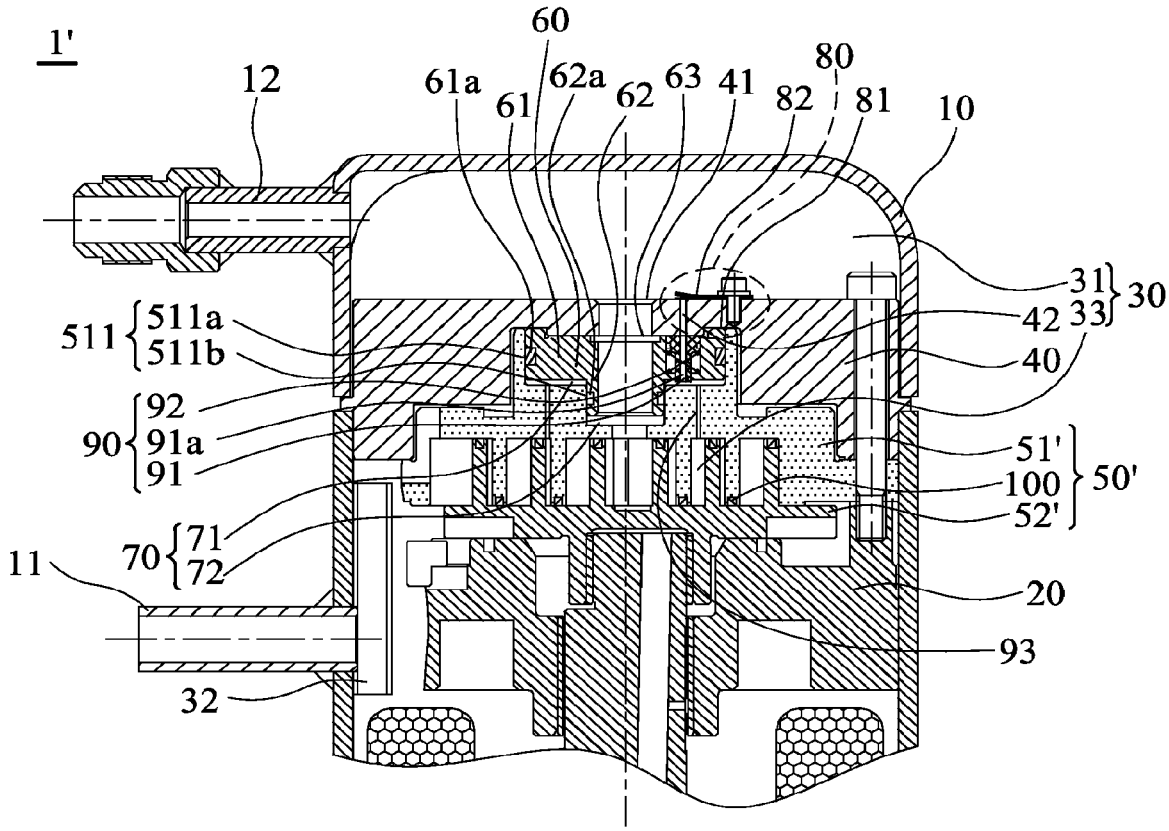
FIG. 4 shows a schematic view of an embodiment of a scroll type compressor of the invention.

FIG. 4 shows an embodiment of the scroll type compressor 1'. The structure of the scroll type compressor 1' is approximately similar to the scroll type compressor 1 shown in FIGS. 1 to 3. The difference between the scroll type compressor 1' and the scroll type compressor 1 is that a fixed scroll 51' of a pair comprising scroll 50' and orbiting scroll 52' of the scroll pair 50' respectively comprise a sealing element 100. Thus, the fixed scroll 51' and the orbiting scroll 52' are tightly joined preventing airflow leakage of compressed airflow when the orbiting scroll 52' revolves around the fixed scroll 51'.

Figure 5:
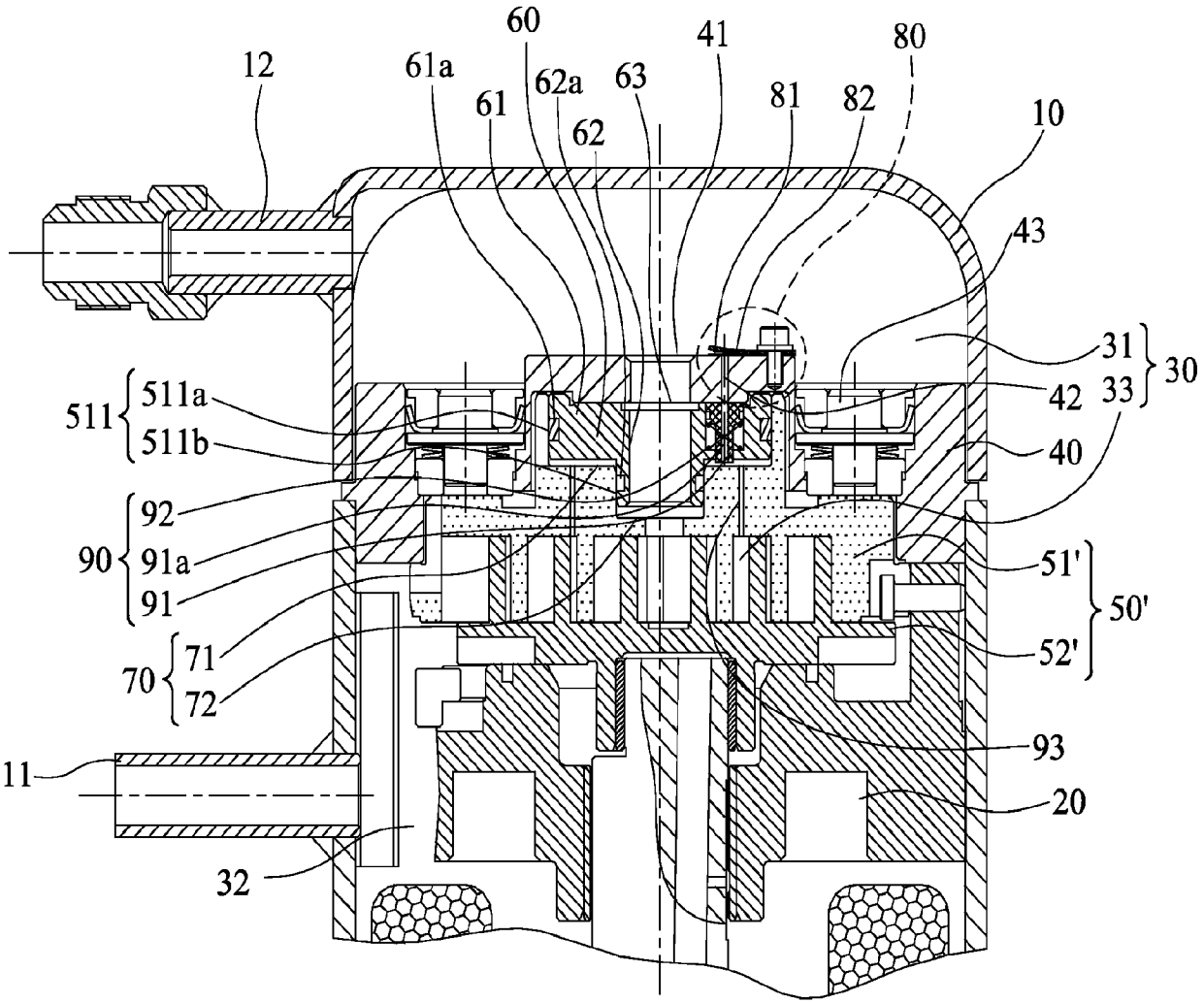
FIG. 5 shows a schematic view of an embodiment of a scroll type compressor of the invention.

FIG. 5 shows an embodiment of the scroll type compressor 1". The structure of the scroll type compressor 1" is approximately similar to the scroll type compressor 1 shown in FIGS. 1 to 3. The difference between the scroll type compressor 1" and the scroll type compressor 1 is that the separator 40 further comprises at least a ring pin preventing leakage of the pressurized airflow.

Note that the number of the pressure-regulating mechanisms 80 and guiding elements 90 are not limited by the above embodiments. The pressure-regulating mechanism 80 and guiding element 90 can be increased in pairs. One pressure-regulating mechanism 80 collocates with one guiding element 90.

Note that the airtight elements 61*a* and 62*a* may be O-rings or other elements according to demand.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A structure for preventing axial leakage in scroll compressor comprising:

a housing, comprising a flow inlet and a flow outlet;

a frame, fixed in the housing;

a compartment, disposed in the housing and separated into a high-pressure compartment, a low-pressure compartment, and a middle-pressure compartment between the high-pressure compartment and the low-pressure compartment;

a separator, disposed between the high-pressure compartment and a low-pressure compartment, comprising an outlet at the center of the separator and at least a passage;

a pair of scrolls, comprising a fixed scroll and a orbiting scroll engaged with the fixed scroll between the separator and the frame;

a slider, movably disposed at the center at the top of the fixed scroll;

a first compartment and a second compartment disposed between the fixed scroll and the slider, the first compartment communicating with the middle-pressure compartment through a channel formed in the fixed scroll;

at least a pressure-regulating mechanism, disposed above the passage of the separator; and a guiding element, disposed in the slider, comprising an air passage connected to the passage of the separator;

wherein the pressure in the high-pressure compartment is less than that in the middle-pressure compartment, the pressure-regulating mechanism opens to exhaust air from the middle-pressure compartment to the high-pressure compartment.

2. The structure as claimed in claim 1, wherein the pressure-regulating mechanism comprises a valve disposed above the passage, when the pressure in the high-pressure compartment is greater than that in the middle-pressure compartment, the valve seals the passage.

3. The structure as claimed in claim 2, wherein the pressure-regulating mechanism further comprises a retaining element disposed above the valve.

4. The structure as claimed in claim 1, wherein the guiding element further comprises a T-shaped element, the passage is installed on the T-shaped element.

5. The structure as claimed in claim 4, wherein the guiding element further comprises a flexible element for keeping the T-shaped element and the separator sealing.

6. The structure as claimed in claim 1, wherein the separator comprises a ring pin preventing leakage of the pressurized airflow.

7. The structure as claimed in claim 1, wherein the fixed scroll and the orbiting scroll further respectively comprise a sealing element.

8. The structure as claimed in claim 1, wherein the fixed scroll comprises a space at the top of the fixed scroll accommodating the slider.

9. The structure as claimed in claim 8, wherein the space comprises a first chamber and a second chamber; the first chamber is disposed above the second chamber; and the diameter of the first chamber is greater than the diameter of the second chamber.

10. The structure as claimed in claim 8, wherein the slider comprises a first portion and a second portion; the first portion is disposed above the second portion; and the diameter of the first portion is greater than the diameter of the second portion.

11. The structure as claimed in claim 10, wherein the first portion and the second portion further respectively comprise an airtight element disposed on the outer edges of the first portion and the second portion.

12. The structure as claimed in claim 11, wherein the airtight element comprises an O-ring.

13. The structure as claimed in claim 1, wherein the slider further comprises a hole connected to the outlet.

* * * * *